United States Patent [19]

Szewczyk

[11] Patent Number: 5,005,480

[45] Date of Patent: Apr. 9, 1991

[54] OPTICAL FUZE

[75] Inventor: Robert M. Szewczyk, Acton, Mass.

[73] Assignee: Raytheon Company, Lexington, Mass.

[21] Appl. No.: 444,331

[22] Filed: Dec. 1, 1989

[51] Int. Cl.[5] ..... F42C 13/02

[52] U.S. Cl. ..... 102/213

[58] Field of Search ..... 102/211, 213, 214

[56] References Cited

U.S. PATENT DOCUMENTS

| | | | |
|---|---|---|---|
| 4,306,500 | 12/1981 | Castanien et al. | 102/213 |
| 4,310,760 | 1/1982 | Gardner | 250/338 |
| 4,709,142 | 11/1987 | Dahl | 250/221 |
| 4,896,606 | 1/1990 | De Coi | 102/213 |

FOREIGN PATENT DOCUMENTS

| | | | |
|---|---|---|---|
| 1337261 | 6/1962 | France | 102/211 |

*Primary Examiner*—Charles T. Jordan
*Assistant Examiner*—Rochelle Lieberman
*Attorney, Agent, or Firm*—Donald F. Mofford; Richard M. Sharkansky

[57] ABSTRACT

Improved apparatus for providing control signals to a warhead in a guided missile is shown to comprise a plurality of optical radars that produce overlapping beams to form a conical coverage pattern and logic circuitry responsive to the signals processed in the receivers of the optical radars to produce control signals indicative of the sector of the conical coverage pattern in which echo signals have originated.

7 Claims, 1 Drawing Sheet

CROSS-SECTION, BEAM BB
CROSS-SECTION, BEAM 10CC
CROSS-SECTION BEAM 10DD
CROSS-SECTION, BEAM 10AA
POLAR ANGLE PA
TA
TB
TC
ANTENNA 10C
ANTENNA 10B
ANTENNA 10A
OPTICAL RADAR 10
LOGIC CIRCUITRY 14
WARHEAD 16
CONTROLLER 12

π/2
π/4
3π/4
2π/0
π
7π/4
5π/4
3π/2
10CC
PA
10DD
10BB
10AA

OPTICAL FUZE

This invention was made with Government support under Contract No. F08635-88-C-0188 awarded by the Department of the Air Force.

BACKGROUND OF THE INVENTION

This invention pertains generally to guided missiles, and particularly to apparatus for providing for fuzing of the warheads in such missiles.

It is known in the art that an active optical fuzing system may be used to good effect when explosive field of warhead in a guided missile is to be directed toward target. In such a system a number of optical radars, say four, are disposed about the body of a guided missile so that the beam of optical energy emitted by a laser in each one of the optical radars in the optical fuzing system is directed to cover a different portion of a conical coverage pattern. When four optical radars are used, the beam of each optical beam encompasses a different quadrant of the conical coverage pattern. As a result, then, only the optical radar having a beam encompassing the particular quadrant of the conical coverage pattern in which the polar angle associated with a particular target lies may receive an echo signal. The quadrant in which the warhead is to be directed then corresponds with the quadrant covered by the beam of the optical radar receiving an echo signal.

If it is desired to improve on the resolution of a known active optical fuzing system, the number of optical radars used in such a system may be increased. However, such an expedient is not well suited to a practical active optical fuzing system because of the added complexity and cost attendant upon increasing the number of optical radars.

SUMMARY OF THE INVENTION

With the foregoing background of the invention in mind, it is a primary object of this invention to increase the angular resolution of an active optical fuzing system without increasing the number of optical radars in such a system.

Another object of this invention is to provide an active optical fuzing system with improved angular resolution without requiring any significant increase in the complexity of associated signal processing equipment.

The recited objects of this invention and other objects that will become clear hereinafter are attained generally by providing, in a guided missile carrying a warhead that is to be directed toward a target whose polar error angle is, a priori, unknown: (a) a plurality of antennas associated with optical radars, say four such radars, such antennas being disposed about the body of the guided missile and arranged so that the beams of such antennas cover overlapping sectors of a conical coverage pattern (2 $\pi$ radians) whereby echo signals from targets in each one of a smaller sector in the conical coverage pattern are received by a different one (or a combination of two) of the optical radars; (b) multiplexing circuitry for separating echo signals received in each one of the four beams; and (c) logic circuitry for determining the particular one of the smaller sectors in which the received echo signals originated.

BRIEF DESCRIPTION OF THE DRAWINGS

For a more complete understanding of this invention, reference is now made to the following description of the accompanying drawings in which.

DESCRIPTION OF THE PREFERRED EMBODIMENT

Figures 1, 2:
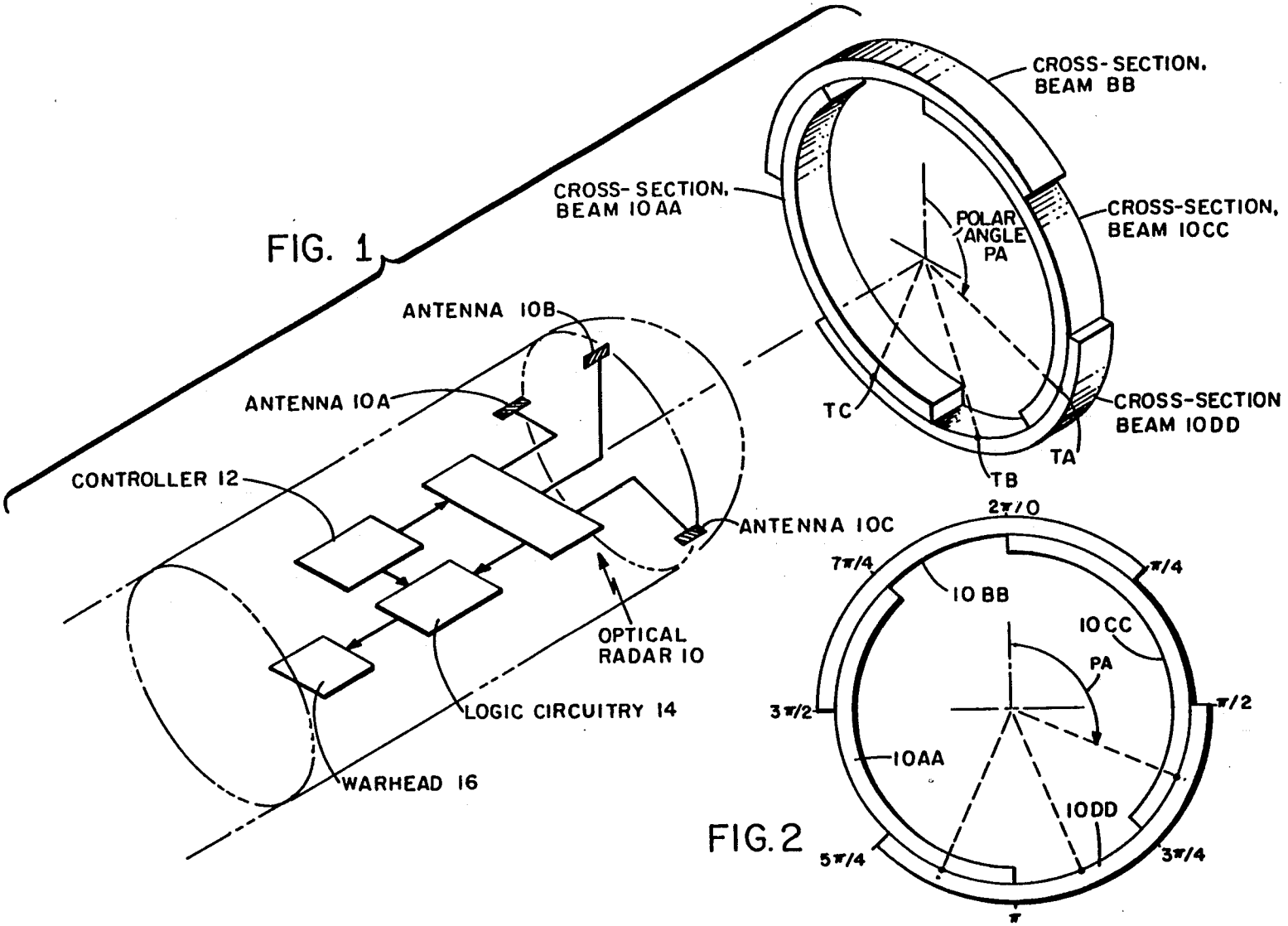
FIG. 1 is a sketch, greatly simplified, of a guided missile and an active optical fuzing system according to this invention.
FIG. 2 is a diagram showing an ideal coverage pattern as here contemplated of beams from lasers in four optical radars in an active optical fuzing system according to this invention.

Referring now to FIG. 1, four optical radars 10 are actuated to produce a substantially conical coverage pattern. Each one of antennas 10A, 10B, 10C, 10D are associated with one of the optical radars 10. However, antenna 10D is not visible because that antenna is located on the body of the guided missile opposite to antenna 10C. As indicated by the exemplary cross-sections of the beams 10AA, 10BB, 10CC, 10DD, each one of the beams encompasses a polar angle, TA, of approximately 3 $\pi/4$ radians. As shown also in the idealized plan representation of FIG. 2, the cross-sections of the beams 10AA, 10BB, 10CC, 10DD are oriented so that the polar angle of a target is , determinative of the particular beam, or beams, in which echo signals are received. The following Truth Table I (wherein "1" means echo signals are received and "0" means echo signals are not received at the antennas 10A, 10B, 10C, 10D) shows how the presence or absence of signals received at the antennas 10A, 10B, 10C, 10D may here be used to determine the octant in which the polar angle of a target lies. It is noted that "antennas" mean any known beam forming arrangements or directional antennas adapted for operation at the frequency of operation of the optical radars.

TRUTH TABLE I

| POLAR ANGLE (RADIANS) | ANTENNA 10A | ANTENNA 10B | ANTENNA 10C | ANTENNA 10D |
|---|---|---|---|---|
| 0 to $\pi/4$ | 0 | 1 | 1 | 0 |
| $\pi/4$ to $\pi/2$ | 0 | 0 | 1 | 0 |
| $\pi/2$ to $3\pi/4$ | 0 | 0 | 1 | 1 |
| $3\pi/4$ to $\pi$ | 0 | 0 | 0 | 1 |
| $\pi$to $5\pi/4$ | 1 | 0 | 0 | 1 |
| $5\pi/4$ to $3\pi/2$ | 1 | 0 | 0 | 0 |
| $3\pi/2$ to $7\pi/4$ | 1 | 1 | 0 | 0 |
| $7\pi/4$ to $2\pi$ | 0 | 1 | 0 | 0 |

For example, in the situations represented in FIGS. 1 and 2:

(a) target TA, having a polar angle between $\pi/2$ and 3 $\pi/4$ radians causes echo signals to appear at antennas 10C and 10D; (b) target TB, having a polar angle between 3 $\pi/4$ and $\pi$ radians causes echo signals to appear only at antenna 10A; and target TC, having a polar angle between $\pi$ and 5 $\pi/4$ radians, causes echo signals to appear at antenna 10A and antenna 10D.

It is evident that some mode of multiplexing is needed to separate the echo signals received at each one of the antennas 10A, 10B, 10C, 10D. Here, time multiplexing is the chosen technique. Thus, a controller 12 is arranged to trigger the optical radars 10 in sequence or to connect antennas 10A, 10B, 10C, 10D in sequence to a single optical radar. In either case, demodulated received signals (and control signals from the controller 12) are passed to logic circuitry 14 wherein appropriate control signals for a warhead 16 are produced in accordance with Truth Table I.

It will be apparent to one of skill in the art that the circuitry of the various elements is conventional and that many different embodiments of the circuitry may be used to effect the objects of the invention. For example, if three antennas were to be spaced equally about the body of a guided missile, with the width of the beam from each one of the three antennas, covering $\pi$ radians, then a coverage pattern would be produced that would result in the following:

TRUTH TABLE II

| POLAR ANGLE (RADIANS) | ANTENNA #1 (0 to $\pi$ RADIANS) | ANTENNA #2 ($2\pi/3$ to $5\pi/3$ RADIANS | ANTENNA #3 $4\pi/3$ to $\pi/3$ RADIANS |
|---|---|---|---|
| 0 to $\pi/3$ | 1 | 0 | 1 |
| $\pi/3$ to $2\pi/3$ | 1 | 0 | 0 |
| $2\pi/3$ to $\pi$ | 1 | 1 | 0 |
| $\pi$ to $4\pi/3$ | 0 | 1 | 0 |
| $4\pi/3$ to $5\pi/3$ | 0 | 1 | 1 |
| $5\pi/3$ to $2\pi$ | 0 | 0 | 1 |

It is felt, therefore, that this invention should not be restricted to any disclosed embodiment, but rather should be limited only by the spirit and scope of the appended claims.

What is claimed is:

1. A radar system comprising:

(a) a plurality of directional antennas disposed at equally spaced positions about a body of a guided missile to produce overlapping beams that, taken together, form a substantially conical coverage pattern and individually provide a beam overlapping each adjacent beam by an amount equal to a portion of the beam that is not overlapping each adjacent beam;

(b) means for separately actuating each one of the directional antennas and for processing any received signals for producing a logic true signal whenever echo signals are received and otherwise a logic untrue signal; and (c) logic circuitry means, responsive to the logic true and logic untrue signals, for producing control signals for a warhead, said control signals being representative of a particular sector of the substantially conical pattern.

2. The radar as recited in claim 1 wherein there are four directional antennas in the plurality of directional antennas and the width of each one of the overlapping beams is $3\pi/4$ radians.

3. The radar as recited in claim 2 wherein the means for separately actuating each one of the directional antennas comprises means for time multiplexing.

4. A directional fuzing system comprising:

(a) means for producing a substantially conical coverage radiation pattern having a plurality of sections, each section provided by a beam of energy and overlapping each adjacent section by an amount equal to a portion of the section that is not overlapping each adjacent section;

(b) means for processing a received signal indicative of a location of a target in any one of the plurality of sections for producing a logic true signal when a received signal is present and a logic untrue signal when a received signal is not present at each respective section; and (c) means, responsive to the logic true and logic untrue signals, for providing a control signal to a warhead indicative of the location of the target.

5. A radar system comprising:

(a) a plurality of antennas disposed to produce a respective plurality of beams, which together provide a substantially conical coverage antenna pattern and individually produce a beam overlapping each adjacent beam by an amount equal to a portion of the beam that is not overlapping each adjacent beam;

(b) means for selectively actuating each of the plurality of antennas and for demodulating received signals for providing logic signals indicative of a presence of a target in the beam of each antenna; and (c) means, responsive to the logic signals, for providing a control signal to a warhead, the control signal indicative of a particular sector of the substantially conical coverage antenna pattern.

6. The radar system as recited in claim 5 wherein the plurality of antennas number four and each one of the respective plurality of beams encompasses a polar angle of $3\pi/4$ radians and each beam is overlapping an adjacent beam by $\pi/4$ radians.

7. The radar system as recited in claim 6 wherein the means for selectively actuating comprises means for time multiplexing including a controller to actuate each antenna.

* * * * *